US007080803B2

(12) United States Patent
Rösch et al.

(10) Patent No.: US 7,080,803 B2
(45) Date of Patent: Jul. 25, 2006

(54) WINDING DEVICES AND A METHOD FOR PREPARING A MATERIAL WEB

(75) Inventors: Andreas Bruno Rösch, Karlstadt (DE); Josef Herbert Olbort, Mainbernheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 216 days.

(21) Appl. No.: 10/488,256

(22) PCT Filed: Sep. 28, 2002

(86) PCT No.: PCT/DE02/03683

§ 371 (c)(1),
(2), (4) Date: Mar. 12, 2004

(87) PCT Pub. No.: WO03/031306

PCT Pub. Date: Apr. 17, 2003

(65) Prior Publication Data

US 2005/0011985 A1 Jan. 20, 2005

(30) Foreign Application Priority Data

Oct. 1, 2001 (DE) ..... 101 48 502

(51) Int. Cl.
*B65H 75/28* (2006.01)

(52) U.S. Cl. ..... 242/532.5; 242/586.5; 242/587.2

(58) Field of Classification Search ..... 242/586, 242/586.5, 586.2, 586.3, 586.4, 587, 587.2, 242/587.3, 532.3, 532.5, 532.6, 332.8
See application file for complete search history.

(56) References Cited

U.S. PATENT DOCUMENTS

| | | | | |
|---|---|---|---|---|
| 407,716 | A * | 7/1889 | Bommarius | 242/586.5 |
| 1,448,125 | A * | 3/1923 | Kiracofe | 242/586.5 |
| 1,759,095 | A * | 5/1930 | Coker | 242/586.5 |
| 2,372,500 | A * | 3/1945 | Knowles et al. | 242/586.5 |
| 2,631,349 | A * | 3/1953 | Houston | 242/586.5 |
| 3,679,199 | A * | 7/1972 | Christensen | 242/586.5 |
| 3,840,196 | A * | 10/1974 | Presentey | 242/586.5 |
| 4,551,127 | A * | 11/1985 | Rich et al. | 242/586.5 |
| 4,742,969 | A | 5/1988 | Masuda et al. | |
| 4,995,406 | A | 2/1991 | da Silva | |
| 5,449,126 | A | 9/1995 | Yee et al. | |
| 5,533,687 | A | 7/1996 | Tice | |
| 5,795,432 | A | 8/1998 | Urban | |
| 5,845,866 | A * | 12/1998 | Kaipf | 242/532.3 |
| 6,491,246 | B1 * | 12/2002 | North et al. | 242/586.5 |

FOREIGN PATENT DOCUMENTS

| | | |
|---|---|---|
| CH | 679 576 A5 | 3/1992 |
| DE | 742 860 | 12/1943 |

(Continued)

*Primary Examiner*—William A. Rivera
(74) *Attorney, Agent, or Firm*—Jones, Tullar & Cooper, P..C.

(57) ABSTRACT

A device that is adapted to wind a web of material includes a winding body to which a start of a material web can be connected. The material web is wound by rotation of the winding body which includes two clamping elements that can be displaced with respect to each other. A clamping gap is defined by these two clamping elements and the start of the material web can be placed in this clamping gap. These two clamping elements of the winding body are pressed against one another while clamping the start of the web. A guiding element, such as a plate is provided to guide the material web start to the clamping gap. A method for preparing a material roll is also disclosed.

28 Claims, 2 Drawing Sheets

FOREIGN PATENT DOCUMENTS

| | | | |
|---|---|---|---|
| DE | 896 565 | | 11/1953 |
| DE | 27 53 085 | A1 | 5/1979 |
| DE | 195 26 445 | A1 | 1/1997 |
| DE | 197 49 894 | A1 | 5/1999 |
| EP | 0 754 505 | A1 | 1/1997 |
| GB | 2 196 936 | A | 5/1988 |

* cited by examiner

WINDING DEVICES AND A METHOD FOR PREPARING A MATERIAL WEB

FIELD OF THE INVENTION

The present invention is directed to devices for winding a web of material, as well as to a method for preparing a web of material. A winding body, on which a start of the web of material can be attached, has clamping elements to grasp the start of the material web.

BACKGROUND OF THE INVENTION

Devices for winding are typically, although not exclusively used, when unpacking rolls of material, for example, in order to be able to subsequently imprint a web of material which is wound on the roll, for example a paper web, in a web-fed rotary printing press. It is the particular task of the winding device to wind up outermost layers of the roll of material, which outermost layers are the so-called waste material, thereby forming a wound body, and in this way to remove these outermost layers. It is moreover also possible to unwind the circumferential packaging from the roll of material by use of such winding devices and to remove this packaging in this way.

To accomplish the winding of the web of material on the winding body, it is necessary to fasten the start of the web on the winding body in a dependable manner.

DE-PS 742 860 describes a winding device for strips of textile material. A start of a web is clamped between two half-shells and is subsequently wound onto them.

SUMMARY OF THE INVENTION

The object of the present invention is directed to providing devices for winding, as well as to a method for preparing a web of material.

In accordance with the present invention, this object is attained by providing a winding body on which a start of a web of material can be fastened. The web of material is wound onto the winding body by rotating the winding body. The winding body includes two clamping elements which can be displaced with respect to each other and which define a clamping gap into which the start of the material web can be inserted. A guide element can be used to guide the web start to the gap. The device can release the web start, once the material has been wound on the winding body, and the material can be discarded.

The advantages to be gained by the use of the present invention lie, in particular, in that two clamping elements are provided on the winding body, which two clamping elements can be displaced with respect to each other. A clamping gap is formed by the clamping elements, into which clamping gap a start of the web of material can be inserted. By an appropriately suitable displacement of at least one of the clamping elements, these two clamping elements are pressed against each other, in the course of which movement, the start of the web is clamped between the clamping elements. A dependable fastening of the web of material on the winding body is thereby provided, because of this non-positive securement in place of the start of the web. It is furthermore dependably provided that, in the course of the rotatory driving of the winding body, the web of material is tightly wound up on the winding body, so that a tightly wound package is created. If it is subsequently intended to remove the package wound on the winding body, the clamping elements or at least one of the clamping elements is displaced for this purpose, and the clamping gap is opened in order to release the start of the web. The wound-up web of material can then be simply drawn laterally off the winding body.

If, in order to form a tight package, the web of material is wound under tension on the winding body, it follows, that the wound-up web of material will be secured under tension against the winding body. Because of the frictional forces acting between the winding body and the innermost layer of the web of material, the web of material can only be pulled off the winding body with difficulty, or possibly even not at all. This problem can be solved, in accordance with the present invention, by providing a width of the clamping gap, at the outer circumference of the winding body, as being adjustable. It is possible to change the effective diameter of the winding body, around which the web of material is looped, by opening the clamping gap which is arranged on the exterior circumference of the winding body. A reduction of the effective diameter of the winding body is then the result of the opening of the clamping gap, so that the web of material, which is wound on the winding body, is relaxed and in this way can be easily pulled off the winding body.

The specific structural configuration of the clamping elements is not the essential aspect of the present invention. In accordance with a preferred embodiment of the present invention, the two clamping elements are configured in the manner of two substantially coaxially arranged shells, on a circumferential surface, which is formed by both shells, the web of material can be wound. In other words, the clamping elements themselves, namely the two shells, constitute the winding body. In this case, the two shells are configured in such a way that the clamping gap, for use in fastening the start of the web of material, is formed by two edges, located opposite each other, of the shells. The coaxially arranged shells can be turned in respect to each other. The corresponding edges of the shells can thus be displaced relatively easily with respect to each other, because of which the clamping gap can be opened or closed.

In order to increase the size, or the effective size of the contact faces on the shells, where frictional forces between the start of the web of material and the shells are transmitted, protrusions can be formed on the edges of the two shells which are forming the clamping gap. These protrusions start at the circumference of the winding body, and extend into the interior of the winding body, so that the web of material is provided with a large contact face.

In order to make possible a rapid insertion of the start of the web into the clamping gap, it is particularly advantageous if a stop is formed on one of the protrusions, with which stop a front edge of the start of the web of material can be brought into contact when the web start being inserted into the clamping gap. Because of this, it is assured, in particular, that prior to closing the clamping gap, the web of material will have been inserted sufficiently deeply into the clamping gap, so that a contact surface of sufficient size between the clamping elements and the start of the web results.

The specific manner in which the drive mechanism of the winding body is provided is basically arbitrary. In accordance with a preferred embodiment of the present invention, one shell of the winding body, and in particular the inner shell, can be rotatorily driven by the use of a drive mechanism. It is possible, on the one hand, to open or close the clamping gap by operation of the rotatory drive mechanism, and the driving movement required for winding up the waste material can be provided on the other hand.

The other or free shell can be seated to be freely rotatable. In this case, it is only passively driven along by the other shell.

In accordance with a preferred embodiment of the present invention, the rotational resistance of the freely rotatable shell can be adjusted. It is possible to assure, by the selection of a sufficiently great rotational resistance, that the rotatorily driveable shell can be moved against the freely rotatable shell and that in the process a sufficiently great clamping force in the clamping gap between the two shells is provided.

The adjustment of the rotation resistance is also of particular advantage when opening the clamping gap. In the course of opening the clamping gap, the driven shell must now be driven in the opposite direction, while the freely rotatable shell must not turn with the driven shell, since otherwise the clamping gap would remain closed. In order to be able to provide for the opening of the clamping gap, even under correspondingly great tension of the wound up web of material, it is therefore particularly advantageous if the freely rotatable shell can be selective braked, or stopped, by the use of a braking device. As a result, the freely rotatable shell can then be stopped in such a way that the driveable shell can move relatively easily and in this way the clamping gap is opened.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

For preparing rolls 01 of material on which a web of material, namely a paper web, has been wound, for printing in a web-fed rotary printing press, it is necessary to remove the circumferential packaging which is typically required for transporting the roll 01 of material. Moreover, to avoid disruptions in the printing press, it is also necessary to unwind the first several layers of the web of material wound on the rolls 01 of material, the so-called waste material, and to remove this waste material prior to the introduction of each material roll 01 into the printing press.

Figure 1:
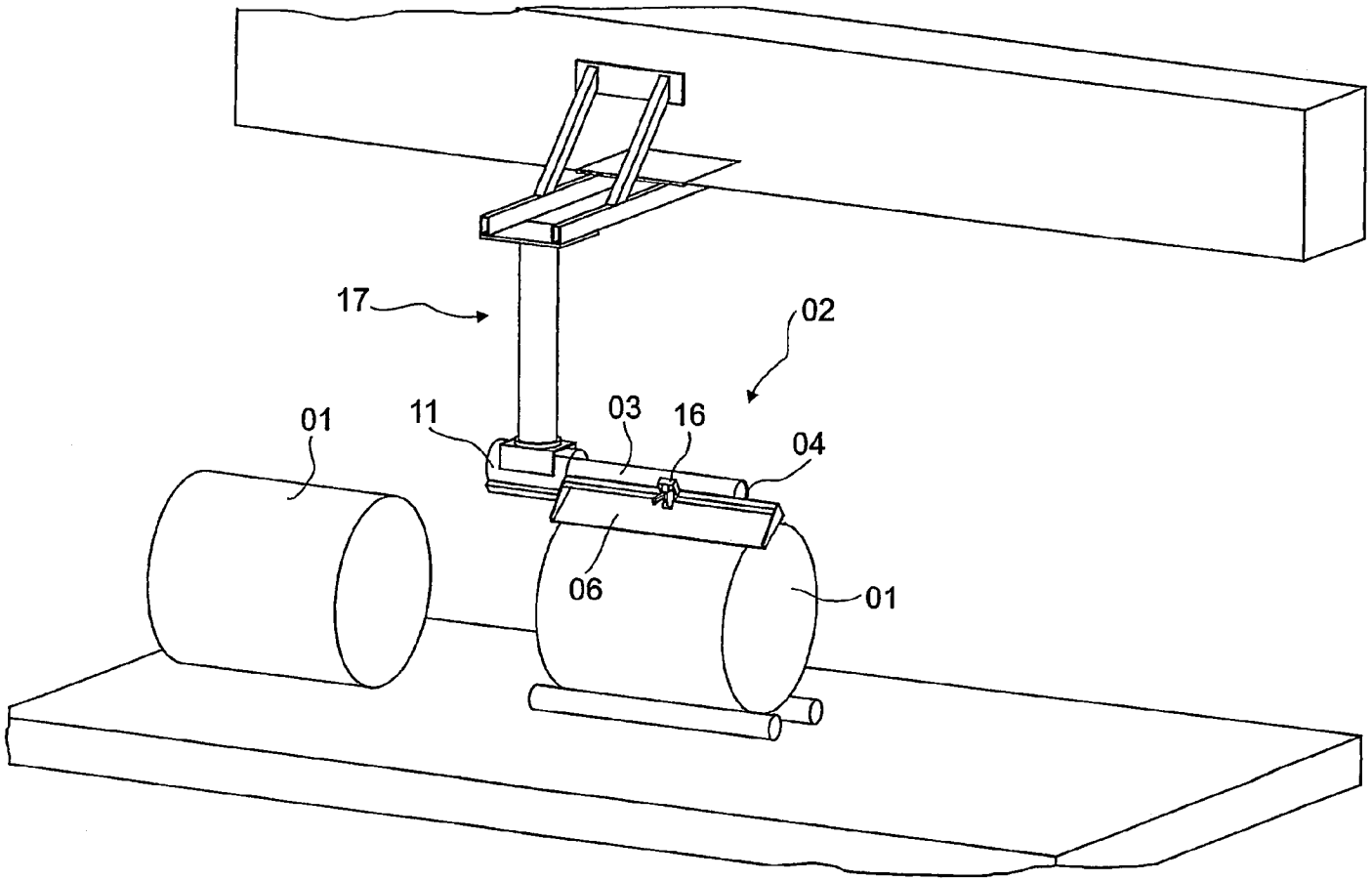
FIG. 1, a perspective view of an unwinding station with rolls of material and with a winding device in accordance with the present invention, and in FIG. 2, the winding device of FIG. 1 in an enlarged partial view.

The removal of the circumferential packaging and of the waste material from each is provided by the use of a winding device 02 in an unpacking station represented in FIG. 1. The winding device 02, in accordance with the present invention is represented, in enlarged form, in FIG. 2.

Figure 2:
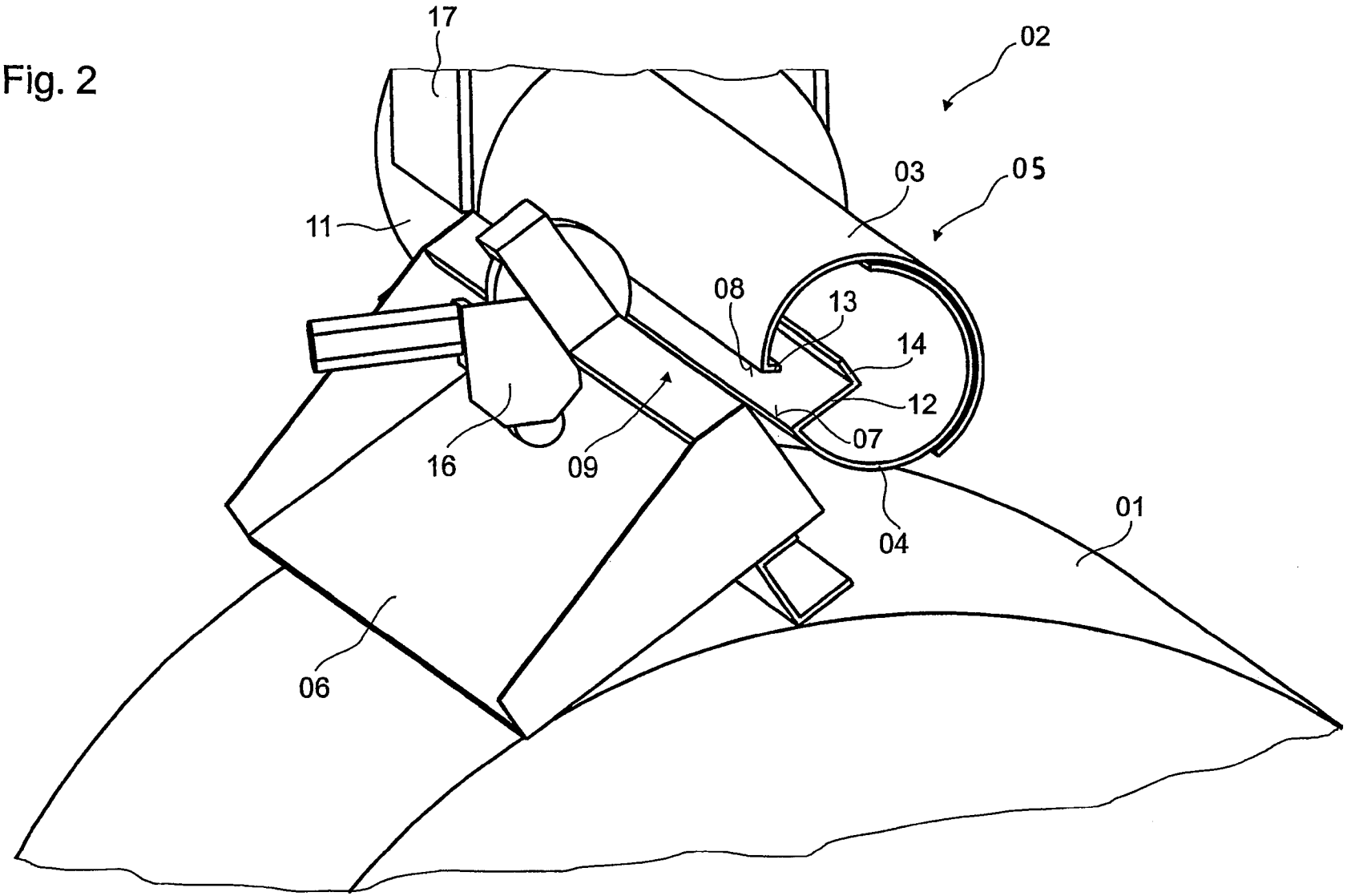

Referring now primarily to FIG. 2, two coaxially arranged, concentric shells 03, 04 are provided on the winding device 02, which two shells 03, 04 together constitute the circumference of a winding body 05 on which the packaging that is typically placed about the circumference of the rolls 01 of material or the waste material can be wound. In the course of unpacking a roll 01 of material, the winding device 02 is arranged over the roll 01 of material in such a way that a guide device 06, which may be embodied in the manner of a guide plate 06, will come to rest on a circumference of the roll 01 of material. The web start of the roll 01 of material can be guided to the winding device 02 by utilization of the guide element 06.

Two edges 07, 08, which are located opposite each other, are provided on the two clamping elements 03, 04, for example the two shells 03, 04, respectively, which two edges 08, 08 between themselves define a clamping gap 09 that is arranged on the circumference of the winding body 05. A web start of the web of material is introduced into this clamping gap 09 via the guide element 06. Thereafter, the inner shell 04 is driven for rotation in a clockwise direction, as seen in FIG. 2, by operating a suitable drive mechanism, not shown, which is arranged inside a housing 11. Simultaneously, the outer shell 03, which is supported as to be freely rotatable, is braked, while maintaining a defined rotation resistance, by the use of a braking device, also not specifically shown, and arranged inside the housing 11. The result is that the two shells 03, 04 are turned, or rotated with respect to each other. As a result, the clamping gap 09 is closed, so that the start of the material web is clamped between the edges 07, 08 of the two clamps or shells 03, 04.

In order to increase an area of contact faces at the shell edges 07, 08, protrusions or flanges 12 or 13, each of which extends into the interior of the winding body 05, are formed on both shell edges 07, 08. In this case, the protrusion or flange 12 on the edge 07 of the inner shell 04 extends farther into the interior of the winding body formed by the two shells 03, 04, so that a stop 14 can be provided on an inner edge of the protrusion or flange 12, against which stop 14 the front edge of the web of material can be brought to rest when introducing the web start into the clamping gap 09.

As soon as the start of the web of material is clamped between the two shells 03, 04, the web of material can be wound on the winding body 05 formed by the shells 03, 04 by driving the inner shell 04 and by releasing the braking device engaging the outer shell 03. The brake is configured in such a way that it always brakes the outer shell 03 with a relatively small, adjustable small braking torque. Otherwise, the clamping force would be too small during the first revolution of the winding body 05. After a sufficient amount of waste material has been removed from the roll 01 of material, and has been wound on the winding body 05, the web of material is manually severed. An adhesive strip can then be applied to an end of the waste material by use of a gluing device 16. The glue carrying web end can now be fixed in place on the circumference of the web of material wound on the shells 03, 04 by use of this adhesive strip. An unintentional unwinding of the web of material is thus prevented.

To remove the web of material, which has been wound on the shells 03, 04, the outer shell 03 is now stopped by the action of the braking device arranged in the housing 11, and the inner shell 04 is now rotated in a counterclockwise direction in relation to the outer shell 03. The clamping gap 09 is opened by this reverse rotation and this releases the start of the wound web of material. In addition, by opening the clamping gap 09 arranged on the circumference of the winding body 05, the effective circumferential length of the winding body 05 is reduced, so that the web of material wound on the shells 03, 04 is relaxed and can be easily pulled laterally off the winding body 05 .

As can be seen in FIG. 1, the winding device 02 is fastened or supported so that it is pivotable around an axis extending perpendicular with respect to the winding axis of the winding body 05, and in particular is pivotable, by use of a turntable, in a horizontal plane, on a support frame 17 which can be arranged on the ceiling of a housing. By horizontal pivoting of the winding device 02, it is possible to pivot the latter in the direction toward a waste paper container, not specifically shown, so that after being pulled off, the waste paper wound on the shells 03, 04 falls into the waste paper container which may be arranged underneath the winding device.

The winding body 05 can also be pivoted around an axis extending perpendicularly in respect to its axis of rotation.

While a preferred embodiment of a winding device and of a method for preparing a material web, in accordance with the present invention have been set forth fully and completely hereinabove, it will be apparent to one of skill in the art that various changes in, for example the drive mechanism and the brake mechanism could be made without departing from the true spirit and scope of the present invention which is accordingly to be limited only by the following claims.

What is claimed is:

1. A device for winding a web of material comprising:

a first clamping element and a second clamping element, said first and second clamping elements forming a winding body having an outer circumferential surface on which a web of material can be wound;

a closable clamping gap in said outer circumferential surface defined by said first and second clamping elements, said clamping gap being adapted to open to receive, and to close to hold a start of a web of material;

means supporting said first and second clamping elements for displacement with respect to each other about a common axis of rotation;

a drive mechanism for rotating said winding body about said common axis of rotation whereby a web of material, whose start is received and held in said clamping gap, can be wound on said winding body; and means supporting said winding body for movement between a first, winding position and a second, waste removal position and including means for pivoting said winding body about a pivot axis, extending generally perpendicular to said axis of rotation of said first and second clamping elements, between said first and second positions.

2. The device of claim 1 wherein one of said first and second clamping elements is driven for rotation by said drive mechanism and further wherein the other of said first and second clamping elements has an adjustable rotation resisting support.

3. The device of claim 1 further including a gluing device positioned adjacent said winding body and being adapted to apply a fastening element to a trailing end of the web of material, said fastening element being usable to secure the web trailing end to the web of material wound on said winding body.

4. The device of claim 3 wherein said fastening element is an adhesive strip.

5. The device of claim 1 wherein in said first, winding position, a web of material can be wound on said winding body, and in said second waste removal position, said web of material wound on said winding body can be removed.

6. The device of claim 5 further wherein said device is positioned in an unwinding station for rolls of material.

7. The device of claim 6 wherein said rolls of material are paper webs.

8. The device of claim 1 wherein said clamping gap has a width at an exterior surface of said winding body and further including means for changing said width.

9. The device of claim 1 wherein said first and second clamping elements are first and second coaxially arranged shells, each said shell including a shell edge, said shell edges of said first and second shells being located opposite to each other and defining said clamping gap.

10. The device of claim 9 wherein a width of said gap is adjustable by said displacement of said first and second shells about said common axis of rotation.

11. The device of claim 9 further including a protrusion on at least one of said shell edges, said at least one protrusion starting at a circumference of said winding body and extending into an interior portion of said winding body.

12. The device of claim 11 further including a stop on said at least one protrusion, said stop being engageable by a start of a web of material inserted in said clamping gap.

13. The device of claim 9 wherein said drive mechanism drives at least one of said shells for rotation about said common axis of rotation.

14. The device of claim 9 wherein one of said first and second shells is rotatably supported for free rotation.

15. The device of claim 14 further including means to adjust a rotation resistance of said freely rotatably supported shell.

16. The device of claim 15 further including a braking device for adjusting said rotation resistance.

17. The device of claim 1 further including a guide element adapted to guide a start of a web of material to said clamping gap.

18. The device of claim 17 wherein said guide element is a guide plate.

19. The device of claim 1 wherein said device is positioned in an unwinding station for rolls of material.

20. The device of claim 19 wherein said rolls of material are paper webs.

21. A method for winding a web of material including:

providing a first clamping element and a second clamping element, said first and second clamping elements defining a winding body;

supporting said first and second clamping elements for relative rotation about a common axis of rotation;

supporting said winding body for pivotal movement about a pivot axis extending generally perpendicular to said axis of rotation;

forming a clamping gap between said first and second clamping elements;

positioning said winding body in a web winding location;

conducting a start of a web of material into said clamping gap;

driving one of said first and second clamping elements for rotation with respect to the other of said first and second clamping elements in a first direction of rotation and closing said clamping gap;

continuing driving said one of said first and second clamping elements in said first direction and driving said other of said first and second clamping elements through said one of said first and second clamping elements;

winding a web of material on said first and second clamping elements during said continued driving of said one of said first and second clamping elements in said first direction while said winding body is in said web winding location;

stopping said driving of said one of said first and second clamping elements in said first direction;

driving said one of said first and second clamping elements in a second direction different from said first direction;

opening said clamping gap and decreasing an effective circumference of said winding body in response to said driving of said one of said first and second clamping elements in said second direction;

moving said winding body about said pivot axis from said web winding location to a web removal location; and removing the web of material from said decreased circumference winding body while said winding body is in said web removal location.

22. The method of claim 21 further including providing a roll of material to be prepared and unwinding the web of material from said roll of material.

23. The method of claim 22 further including severing a trailing end of the web of material wound on said winding body from the roll of material.

24. The method of claim 22 further including securing said trailing end of the web of material to said web of material wound on said winding body.

25. The method of claim 22 further including supporting said roll of material for rotation during said winding of said web of material.

26. The method of claim 21 further including removing said web of material in the direction of said common axis of rotation at said web removal location.

27. A device for winding a web of material comprising:

a first, outer shell and a second, inner shell, said outer and inner shells being concentric and forming a cylindrical winding body having an outer circumferential surface on which winding body a web of material can be wound;

a first radially inwardly extending clamping flange on said first, outer shell;

a second radially inwardly extending clamping flange on said second, inner shell;

a stop flange on a radially inner end of one of said first and second clamping flanges;

a closable clamping gap defined by said first and second clamping flanges, said clamping gap being adapted to open to receive, and to close to hold a start of a web of material, said start of said web received in said clamping gap engaging said stop flange;

means supporting said first, outer shell and said second, inner shell for rotational displacement with respect to each other about a common axis of rotation to selectively open and close said clamping gap;

a drive mechanism for rotating said winding body about said inner shell and outer shell common axis of rotation to hold a start of a web of material, received and held in said clamping gap, to wind the web of material on said outer circumferential surface of said winding body.

28. The device of claim 27 wherein a width of said clamping gap is adjustable by said rotational displacement of said first and second shells about said common axis of rotation.

* * * * *